US010501986B2

(12) United States Patent
Cheng

(10) Patent No.: US 10,501,986 B2
(45) Date of Patent: Dec. 10, 2019

(54) CURTAIN REEL STRUCTURE FOR ASSEMBLING BLIND CORD RAPIDLY

(71) Applicant: CHEN TIAN CO., LTD., Tainan (TW)

(72) Inventor: Ching-Hsiang Cheng, Tainan (TW)

(73) Assignee: Chen Tian Co., Ltd., Tainan (TW)

( * ) Notice: Subject to any disclaimer, the term of this patent is extended or adjusted under 35 U.S.C. 154(b) by 41 days.

(21) Appl. No.: 15/989,498

(22) Filed: May 25, 2018

(65) Prior Publication Data

US 2019/0218856 A1 Jul. 18, 2019

(30) Foreign Application Priority Data

Jan. 18, 2018 (TW) ..... 107101880 A

(51) Int. Cl.
*E06B 9/32* (2006.01)
*E06B 9/322* (2006.01)
*B65H 75/44* (2006.01)

(52) U.S. Cl.
CPC ..... *E06B 9/322* (2013.01); *B65H 75/4402* (2013.01); *B65H 75/4471* (2013.01); *E06B 2009/3225* (2013.01); *E06B 2009/3227* (2013.01)

(58) Field of Classification Search
CPC .... E06B 9/32; E06B 9/322; E06B 2009/3225; E06B 2009/3227; B65H 75/4402; B65H 75/4471
See application file for complete search history.

(56) References Cited

U.S. PATENT DOCUMENTS

2010/0147470 A1* 6/2010 Wong ..... E06B 9/322 160/370
2014/0083630 A1* 3/2014 Wu ..... E06B 9/322 160/84.04
2016/0208551 A1* 7/2016 Huang ..... E06B 9/60
2018/0155981 A1* 6/2018 Guerra ..... E06B 9/322

FOREIGN PATENT DOCUMENTS

TW 417467 U 1/2001
TW 537000 U 6/2003
TW 287117 U 2/2006

* cited by examiner

*Primary Examiner* — Sang K Kim
(74) *Attorney, Agent, or Firm* — Rosenberg, Klein & Lee

(57) ABSTRACT

A curtain reel structure for assembling a blind cord rapidly is disclosed herein. It mainly comprises a winding spool, a reel seat on which the winding spool is assembled, a first positioning device disposed between the winding spool and the reel seat and having a first chamber and a first sliding seat inserted into the first chamber, wherein the first sliding seat is provided with a first accommodating slot for accommodating the blind cord, and a second positioning device disposed between the winding spool and the reel seat and having a second chamber and a second sliding seat inserted into the second chamber, wherein the second sliding seat is provided with a second accommodating slot for accommodating the blind cord.

8 Claims, 10 Drawing Sheets

CURTAIN REEL STRUCTURE FOR ASSEMBLING BLIND CORD RAPIDLY

BACKGROUND OF THE INVENTION

1. Field of the Invention

The present invention relates to a curtain reel structure for assembling a blind cord rapidly which uses a simple way to pull a blind cord to achieve effects of rapidly assembling and positioning the blind cord on a curtain reel structure.

2. Description of Related Art

Generally, the curtains of the retractable type are mainly installed in the rail with a plurality of rollers for winding up or releasing the strings so as to control the curtains to vertically shrink or extend. For instance, a Taiwan Patent No. TW417467 (U), issued on 1 Jan. 2001, and a Taiwan Patent No. TW537000 (U), issued on 11 Jun. 2003, have respectively disclosed a "rope winding device for a window curtain" and an "improved string collect seat". However, the end caps of the foregoing structures need to be adjustably assembled on the rolling cylinder in position, so that the hexagonal holes at two ends of the rolling cylinder can be aligned for the revolving shafts of the curtain to pass through, which will substantially consume much more time in assembling the foregoing structures. Furthermore, the traditional bearing seat usually comprises two axial supporting parts for pivotally connecting the two ends of the rolling cylinder, so the structure is complicated and also time-consuming to assemble the rolling cylinder.

Accordingly, a Taiwan Patent No. TWM287117 (U), issued on 11 Feb. 2006, has disclosed a "reel device for a curtain" to solve the above-mentioned problems. Although the string of the foregoing structure can be fixed by the reel device, it needs to pass through the hole on the basal plate, correspondingly pass through a slot on the open end face of the second end by its top end, and then to be positioned by covering the cap on the open end of the second end, so the foregoing structure are complicated to assemble and cannot be rapidly positioned.

SUMMARY OF THE INVENTION

Therefore, in view of the above-mentioned problems, the aspect of the present invention is to provide a curtain reel structure for assembling a blind cord rapidly which uses a simple way to pull a blind cord to achieve effects of rapidly assembling and positioning the blind cord on a curtain reel structure.

Disclosed herein is a curtain reel structure for assembling a blind cord rapidly. It mainly comprises a winding spool, a reel seat on which the winding spool is assembled and having a neck part, and a first positioning device and a second positioning device which are disposed between the winding spool and the reel seat.

The first positioning device is provided with a first chamber and a first sliding seat for inserting into the first chamber, and the first sliding seat is further provided with a first accommodating slot for accommodating a blind cord. The second positioning device is provided with a second chamber and a second sliding seat for inserting into the second chamber, and the second sliding seat is further provided with a second accommodating slot for accommodating the blind cord. Accordingly, a pull on the blind cord makes the first accommodating slot of the first sliding seat and the second accommodating slot of the second sliding seat respectively stagger with the first chamber and the second chamber so as to lock the blind cord and achieve effects of rapidly assembling and positioning the blind cord on the curtain reel structure.

According to an embodiment of the present invention, the first chamber is provided with a first opening for allowing insertion of the first sliding seat and a first active channel on the other side thereof for communicating the first chamber with an external, and the second chamber is provided with a second opening for allowing insertion of the second sliding seat and a second active channel on the other side thereof for communicating the second chamber with the external.

DETAILED DESCRIPTION OF THE PREFERRED EMBODIMENT

Hereinafter, an exemplary embodiment of the present invention will be described in detail with reference to the accompanying drawings.

Figure 1:
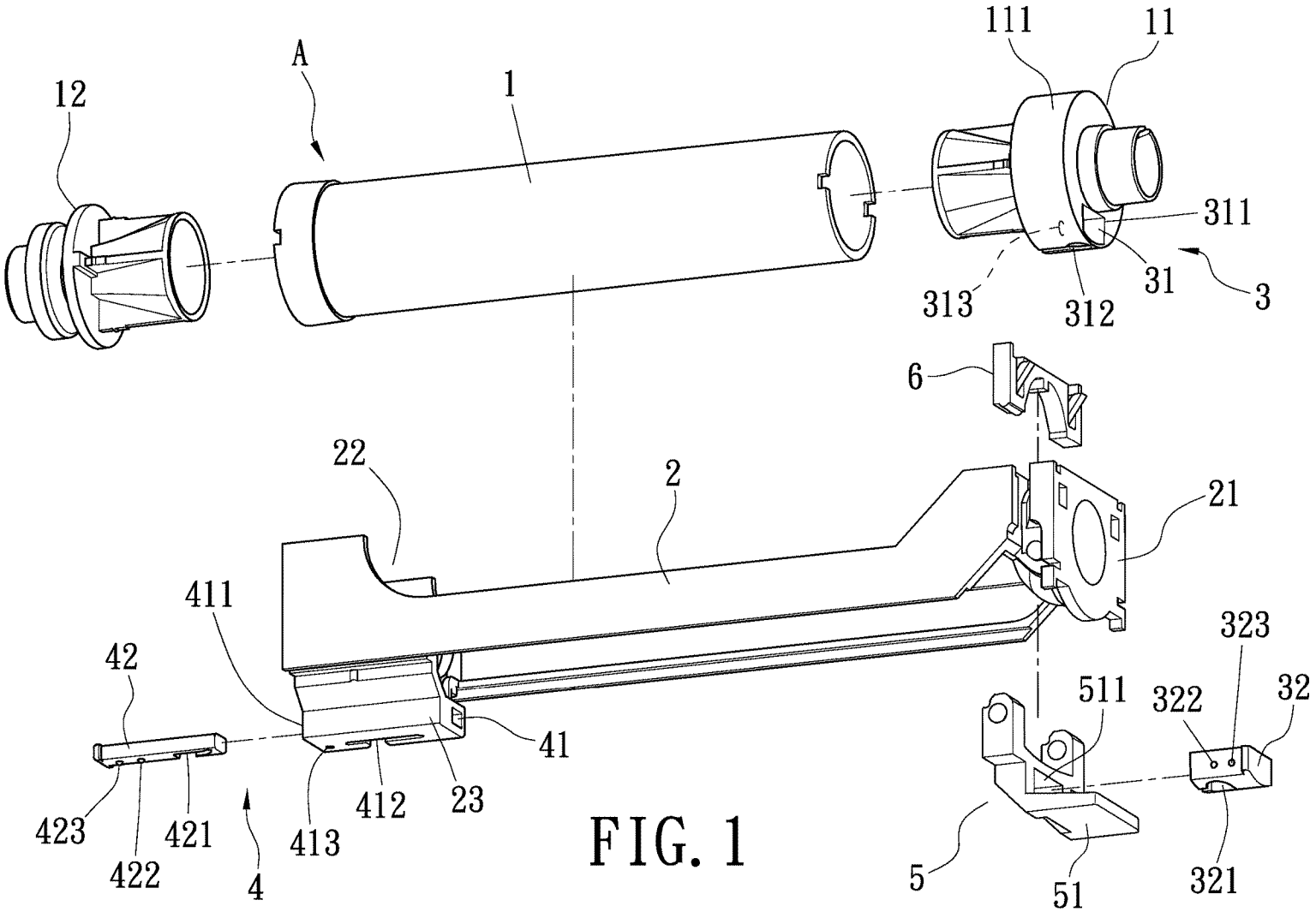
FIG. 1 is an explosion diagram showing a curtain reel structure for assembling a blind cord rapidly according to the present invention.
Figure 2:
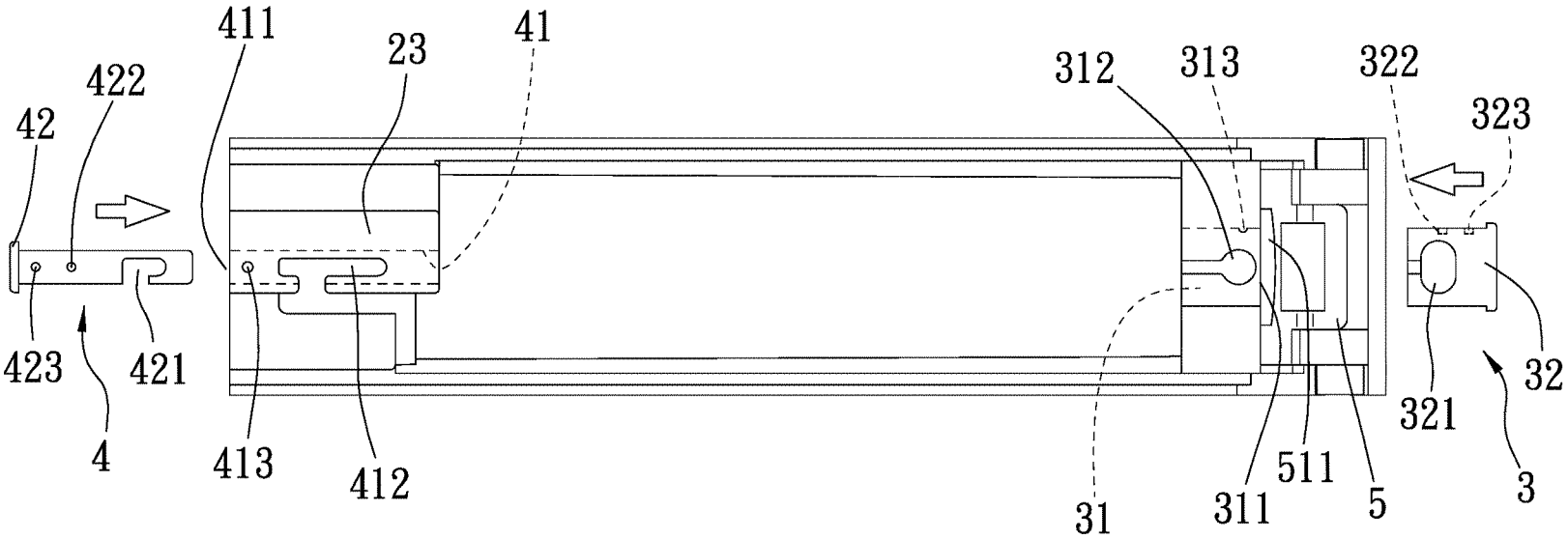
FIG. 2 is a top view showing a curtain reel structure for assembling a blind cord rapidly according to the present invention.
Figure 3:
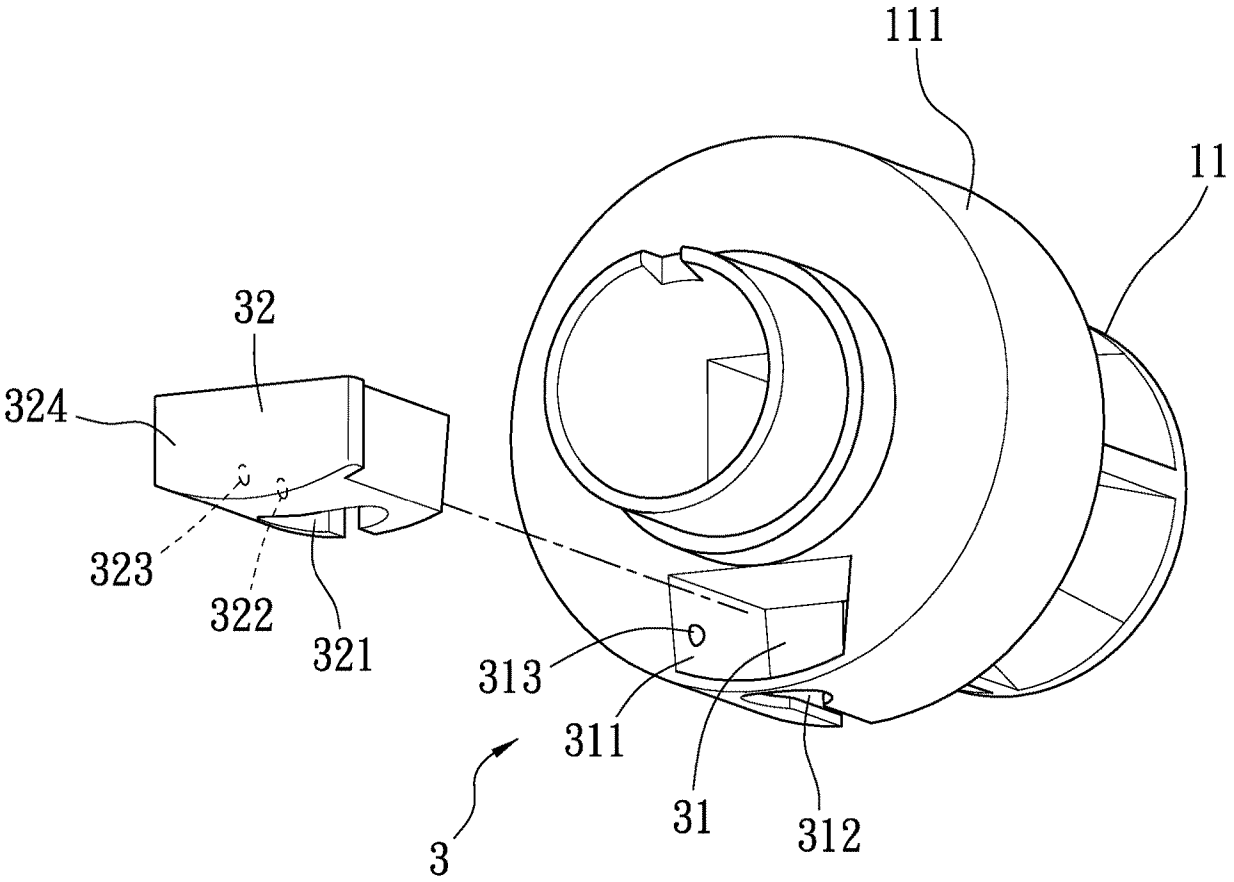
FIG. 3 is a partial explosion diagram for a first embodiment showing a first positioning device according to the present invention.
Figure 4:
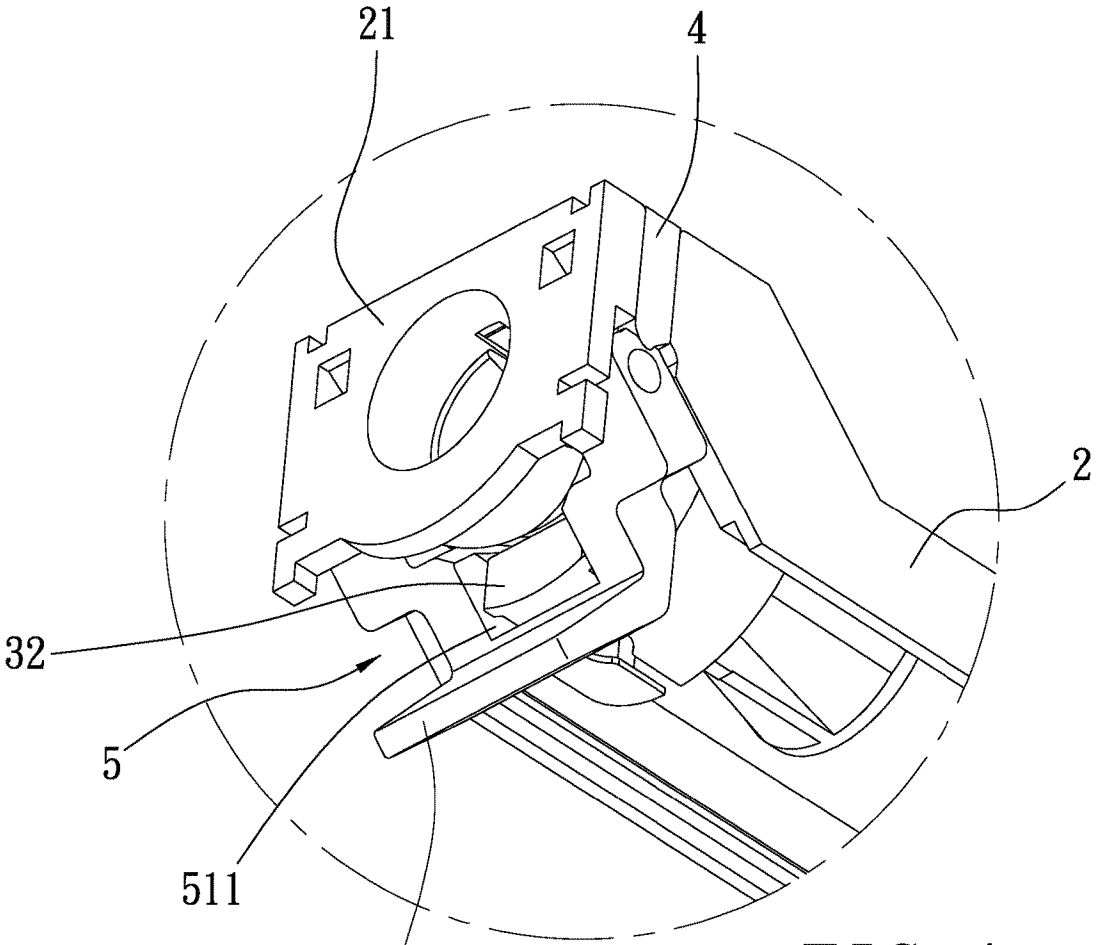
FIG. 4 is a partial enlarged view for the first embodiment showing a curtain reel structure for assembling a blind cord rapidly in assembly according to the present invention.
Figure 5:
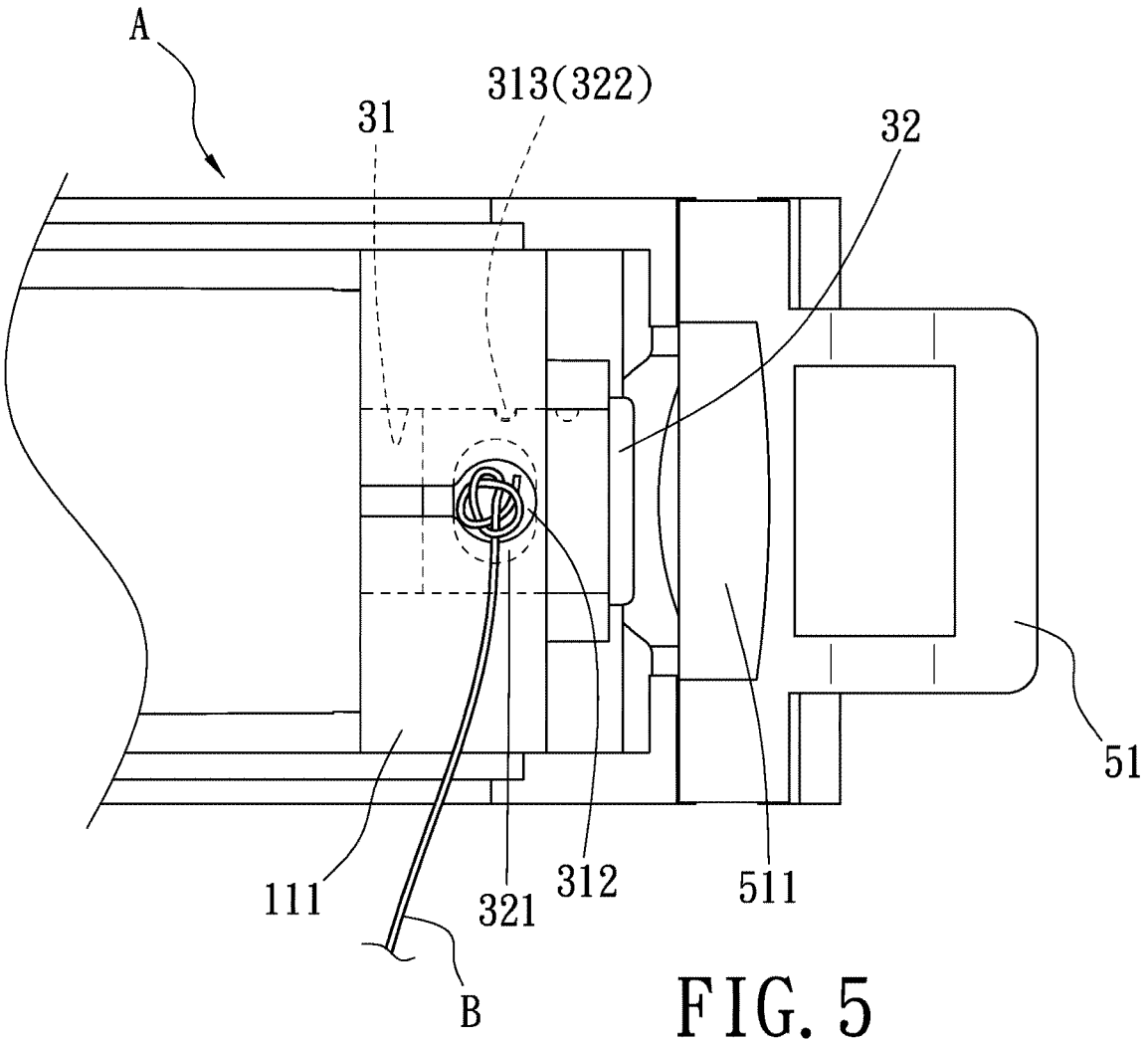
FIG. 5 is a first cross-sectional view for the first embodiment showing a curtain reel structure for assembling a blind cord rapidly in use according to the present invention.
Figure 6:
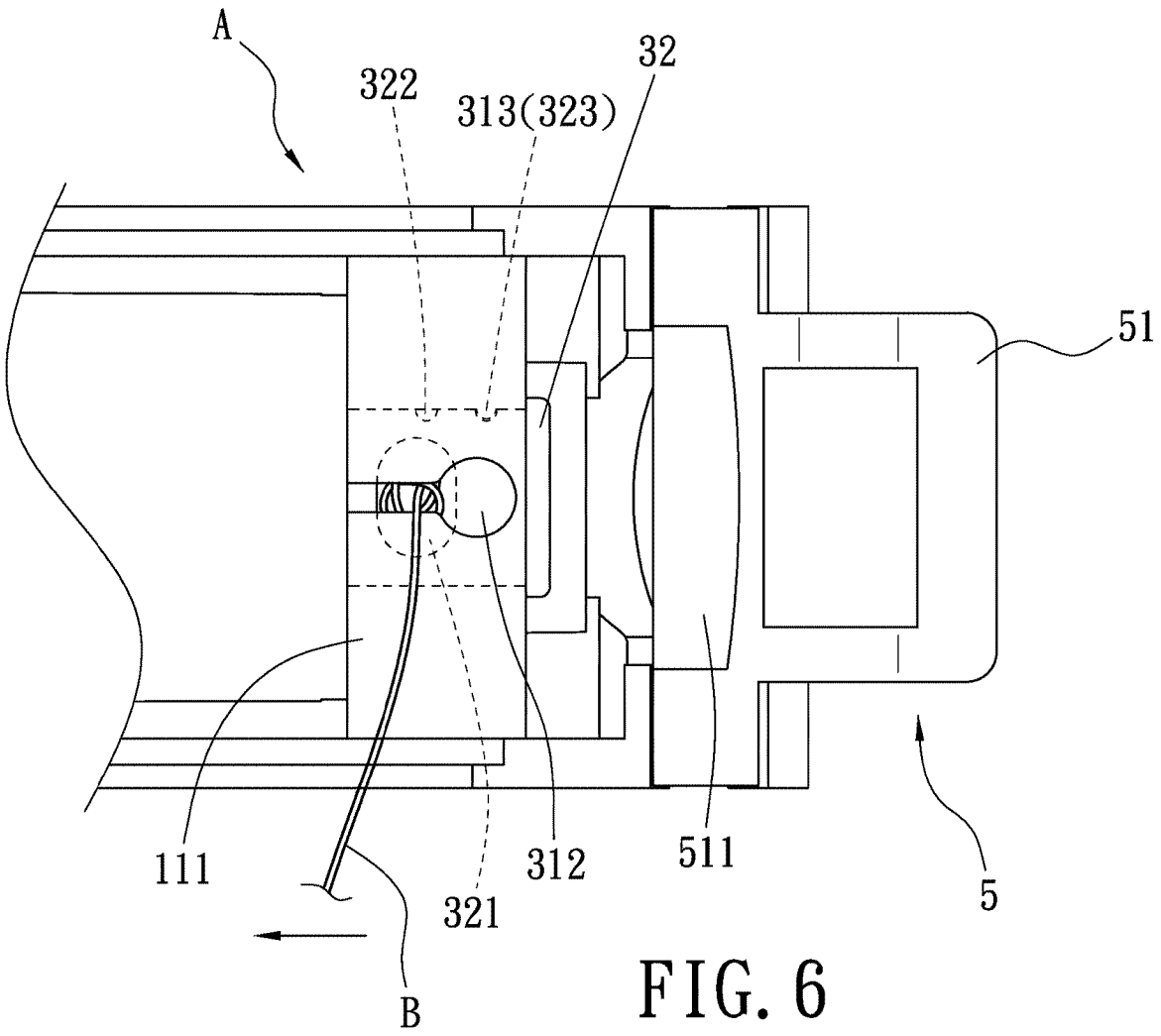
FIG. 6 is a second cross-sectional view for the first embodiment showing a curtain reel structure for assembling a blind cord rapidly in use according to the present invention.

Referring to FIG. 1 to FIG. 2, a curtain reel structure for assembling a blind cord rapidly of the present invention is disclosed herein. The curtain reel structure (A) mainly comprises a winding spool (1), a reel seat (2) on which the winding spool (1) is assembled, and a first positioning device (3) and a second positioning device (4) which are disposed between the winding spool (1) and the reel seat (2).

The first positioning device (3) is provided with a first chamber (31) and a first sliding seat (32). The first chamber (31) is provided with a first opening (311) for allowing insertion of the first sliding seat (32) and a first active channel (312) on the other side thereof for communicating the first chamber (31) with an external. The first sliding seat (32) is provided with a first accommodating slot (321) for accommodating the blind cord (B) and corresponding to or staggering with the first active channel (312). The second positioning device (4) is provided with a second chamber (41) and a second sliding seat (42). The second chamber (41) is provided with a second opening (411) for allowing insertion of the second sliding seat (42) and a second active channel (412) on the other side thereof for communicating the second chamber (41) with the external. The second sliding seat (42) is provided with a second accommodating slot (421) for accommodating the blind cord (B) and corresponding to or staggering with the second active channel (412). Accordingly, a pull on the blind cord (B) making the first accommodating slot (321) of the first sliding seat (32) and the second accommodating slot (421) of the second sliding seat (42) respectively stagger with the first active channel (312) of the first chamber (31) and the second active channel (412) of the second chamber (41) so as to lock the blind cord (B).

In practical assembly of the present invention, the winding spool (1) of the curtain reel structure (A) is provided with a first axial part (11) at one end and a second axial part (12) at the other end, and the reel seat (2) is provided with a first engaging part (21) at one end and a second engaging part (22) at the other end respectively for engaging with the first axial part (11) and the second axial part (12) so as to assemble the winding spool (1) on the reel seat (2). Furthermore, the first positioning device (3) and the second positioning device (4) can be assembled to the winding spool (1) or the reel seat (2).

A first embodiment of a curtain reel structure for assembling a blind cord rapidly is disclosed as FIG. 3 to FIG. 6. The positioning device (3) is disposed on the first axial part (11), and the first axial part (11) is provided with an outer rim (111) on which the first chamber (31) is located. The first opening (311) faces outward, and the first active channel (312) is disposed on a ring surface of the outer rim (111) for communicating the first chamber (31) with the external. The first sliding seat (32) is inserted into the first chamber (31) from the first opening (311). The first sliding seat (32) is provided with the first accommodating slot (321) for corresponding to or staggering with the first active channel (312) and for accommodating the blind cord (B) so that a pull on the blind cord (B) making the first accommodating slot (321) of the first sliding seat (32) stagger with the first active channel (312) of the first chamber (31) so as to lock the blind cord (B). In actual operation, the first sliding seat (32) is inserted into the first chamber (31) on the outer rim (111). The inner wall of the first chamber (31) is further provided with a first engaging unit (313), and the first sliding seat (32) is further provided with a first joint unit (322) and a second joint unit (323) for correspondingly engaging with the first engaging unit (313). The first joint unit (322) of the first sliding seat (32) is correspondingly positioned in the first engaging unit (313) of the first chamber (31). When the positioning is completed, the first accommodating slot (321) of the first sliding seat (32) is correspondingly aligned with the first active channel (312). Meanwhile, the blind cord (B) is allowed to pass through the first active channel (312) and engage in the first accommodating slot (321), and then the blind cord (B) is pulled to move along the first active channel (312), allowing the blind cord (B) located in the first accommodating slot (321) to drive the first sliding seat (32) to move in the first chamber (31) and the first accommodating slot (321) to stagger with the first active channel (312). Therefore, the blind cord (B) is clamped in a gap generated by staggering. The second joint unit (323) of the first sliding seat (32) is correspondingly inserted into the first engaging unit (313) of the first chamber (31) to position the blind cord (B) so as to achieve effect of rapid and easy assembly.

Figure 7:
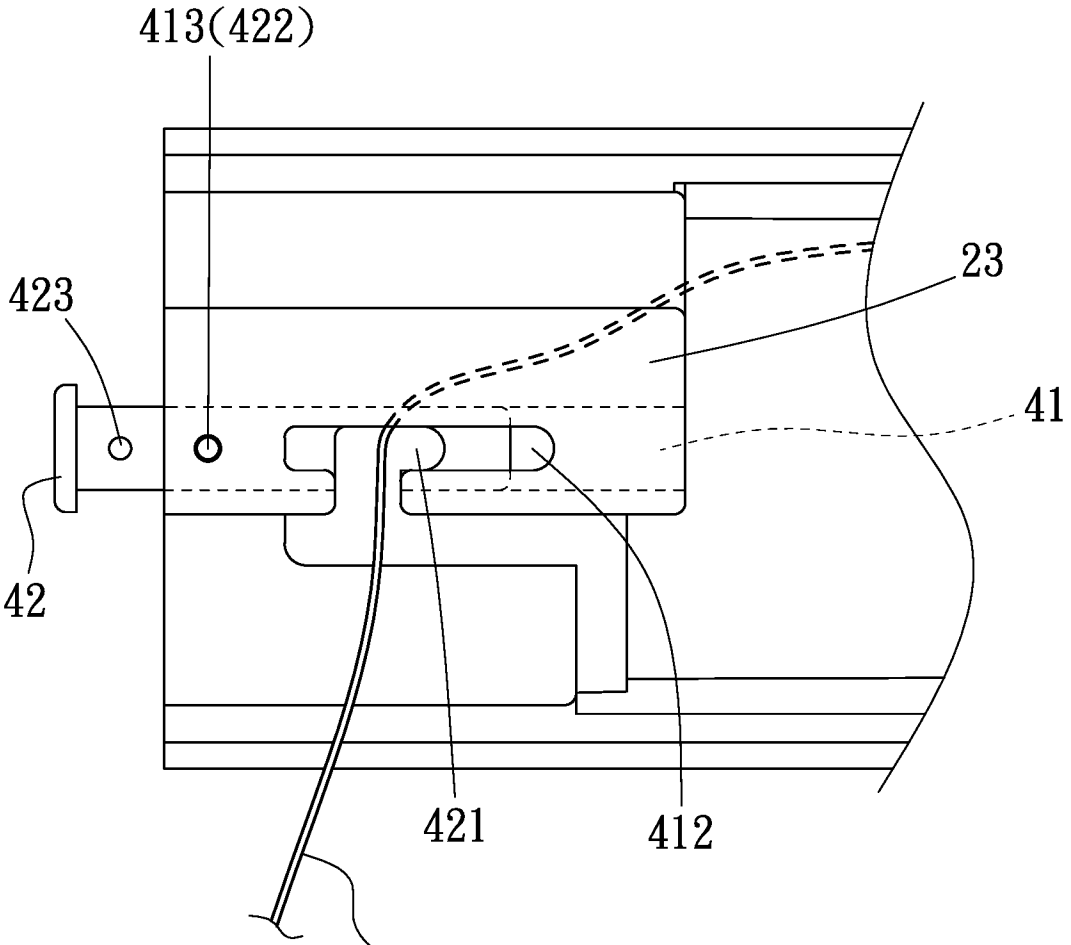
FIG. 7 is a first cross-sectional view for a second embodiment showing a curtain reel structure for assembling a blind cord rapidly in use according to the present invention.
Figure 8:
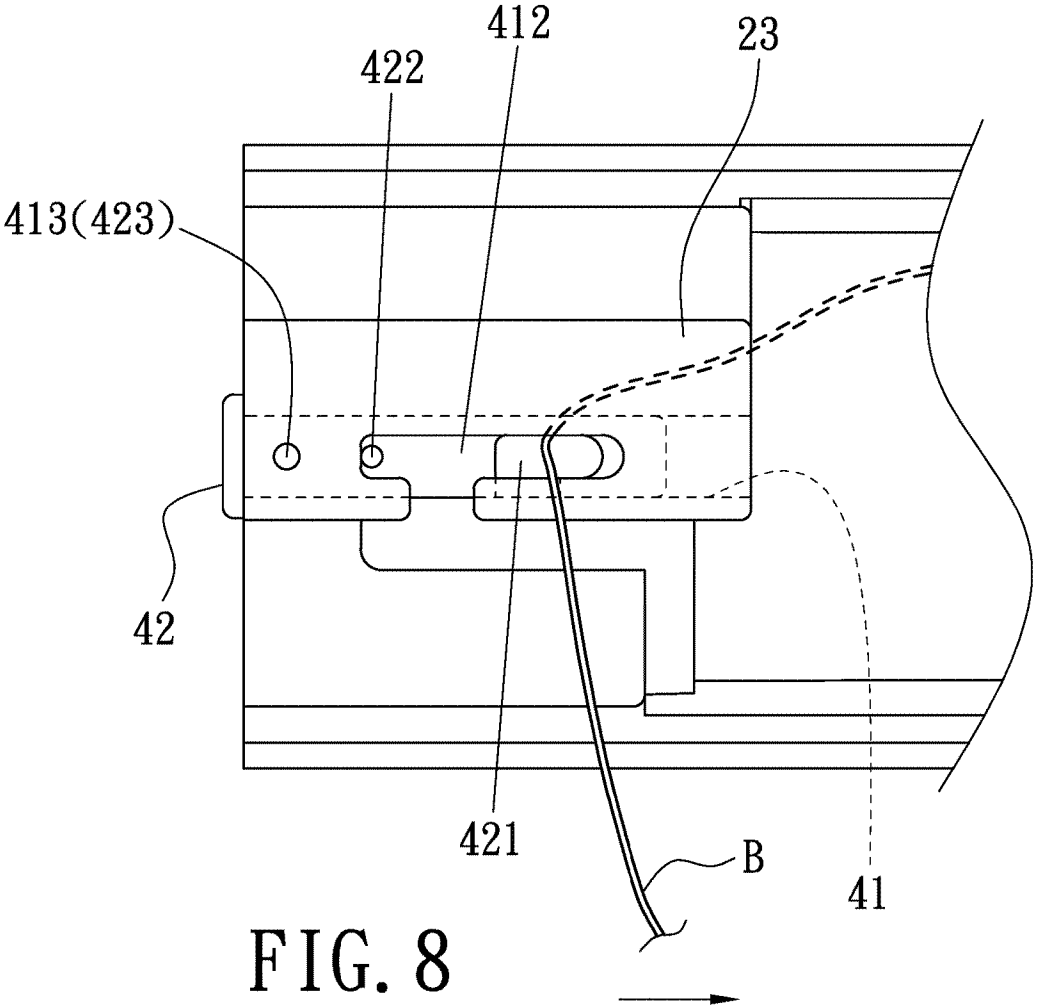
FIG. 8 is a second cross-sectional view for the second embodiment showing a curtain reel structure for assembling a blind cord rapidly in use according to the present invention.

A second embodiment of a curtain reel structure for assembling a blind cord rapidly is disclosed as FIG. 7 to FIG. 8. The second positioning device (4) and a platform (23) are disposed at a bottom of the second engaging part (22). The second chamber (41) is located within the platform (23) and provided with the second opening (411) facing outward and the second active channel (412) disposed at a bottom of the platform (23) for communicating the second chamber (41) with the external. The second opening (411) of the second chamber (41) allows insertion of the second sliding seat (42), and the second sliding seat (42) is provided with a second accommodating slot (421) for accommodating the blind cord (B) and corresponding to or staggering with the second active channel (412) so that a pull on the blind cord (B) making the second accommodating slot (421) of the second sliding seat (42) stagger with the second active channel (412) of the second chamber (41) so as to lock the blind cord (B). In actual operation, the second sliding seat (42) is correspondingly inserted into the second chamber (41) within the platform (23). The inner wall of the second chamber (41) is further provided with a second engaging unit (413), and the second sliding seat (42) is further provided with a third joint unit (422) and a fourth joint unit (423) for correspondingly engaging with the second engaging unit (413). The third joint unit (422) of the second sliding seat (42) is correspondingly positioned in the second engaging unit (413) of the second chamber (41). When the positioning is completed, the second accommodating slot (421) of the second sliding seat (42) is correspondingly aligned with the second active channel (412). Meanwhile, the blind cord (B) is allowed to pass through the second active channel (412) and engage in the second accommodating slot (421), and then the blind cord (B) is pulled to move along the second active channel (412), allowing the blind cord (B) located in the second accommodating slot (421) to drive the second sliding seat (42) to move in the second chamber (41) and the second accommodating slot (421) to stagger with the second active channel (412). Therefore, the blind cord (B) is clamped in a gap generated by staggering. The fourth joint unit (423) of the second sliding seat (42) is correspondingly inserted into the second engaging unit (413) of the second chamber (41) to position the blind cord (B) so as to achieve effect of rapid and easy assembly.

Furthermore, the first engaging unit (313) on the inner wall of the first chamber (31) and the second engaging unit (413) on the inner wall of the second chamber (41) are formed as recessed slots or bumps, and the first and the second joint units (322) (323) and the third and the fourth joint units (422) (423) are formed as bumps or recessed slots respectively corresponding to the first engaging unit (313) and the second engaging unit (413).

Figure 9:
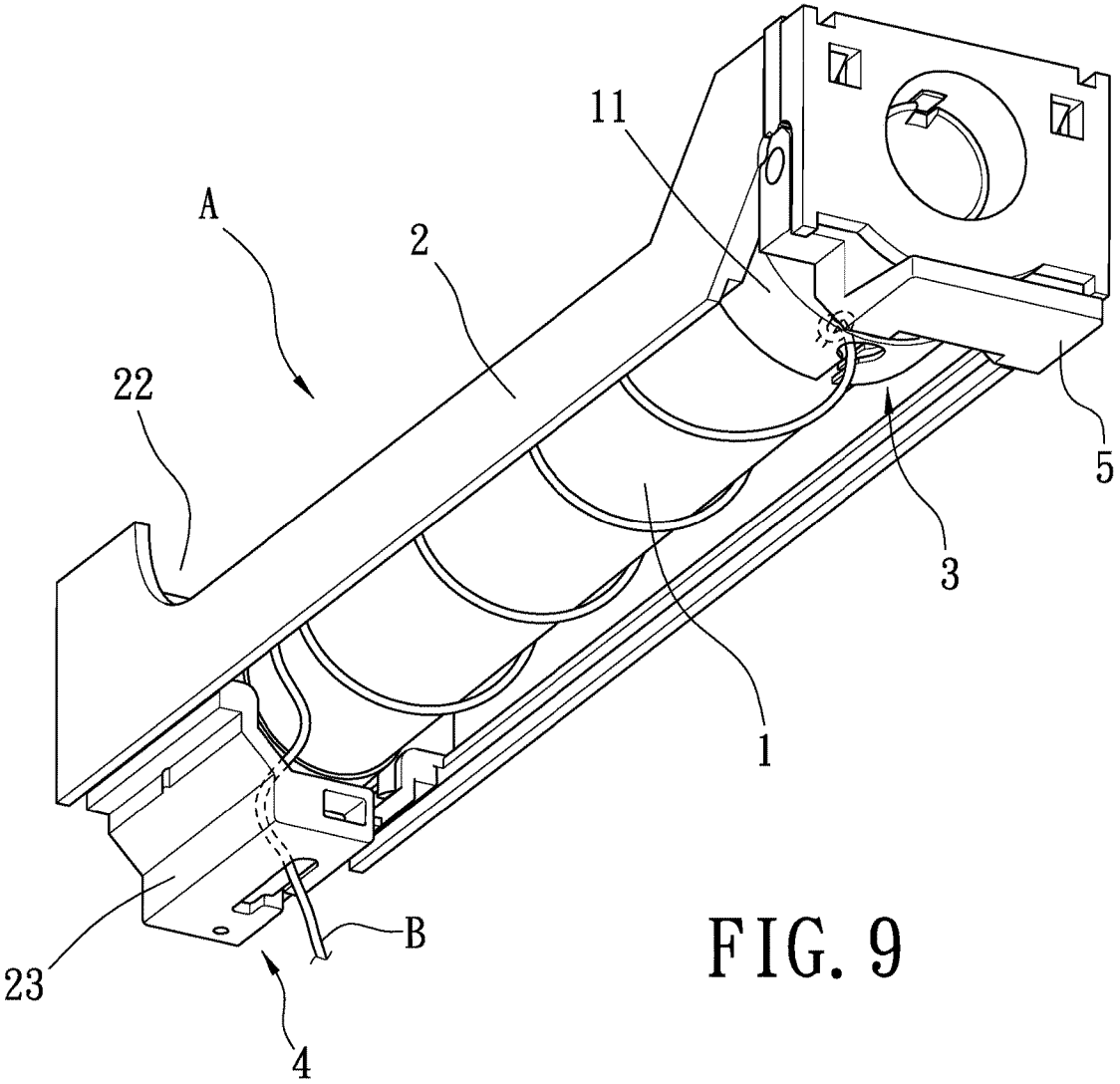
FIG. 9 is a stereogram showing a curtain reel structure for assembling a blind cord rapidly in assembly according to the present invention.
Figure 10:
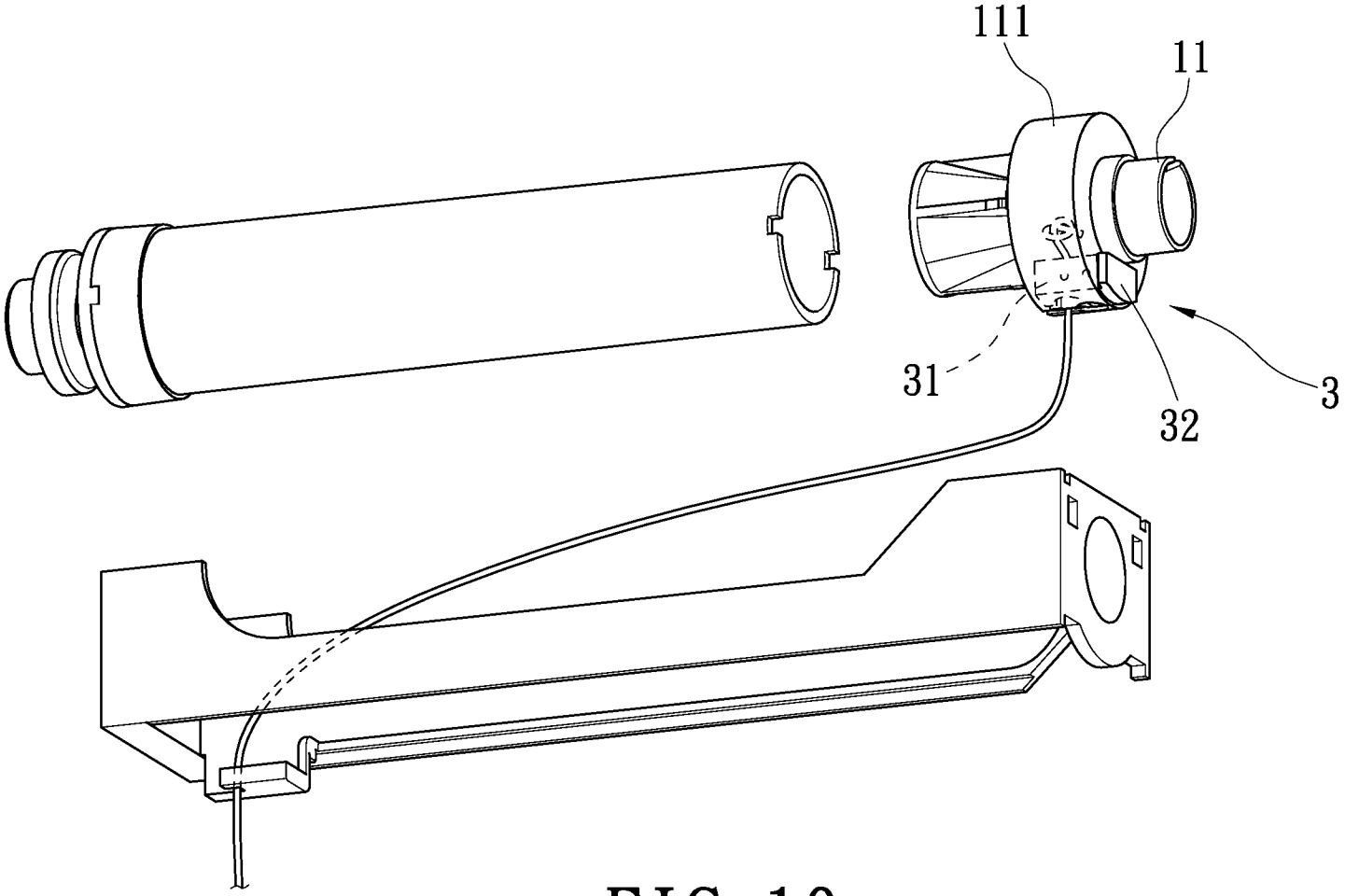
FIG. 10 is a schematic diagram showing an application of the present invention to a traditional curtain reel structure.

Referring to FIG. 9, the first embodiment and the second embodiment can be further used in combination. The blind cord (B) is positioned in the first positioning device (3) on the first axial part (11) and in the second positioning device (4) at the second engaging part (22). Additionally, the first positioning device (3) and the second positioning device (4) of the present invention can also be applied to a traditional curtain reel. As shown in FIG. 10, an axial part of the winding spool (1) of the traditional curtain reel is replaced with the first axial part (11) of the present invention. The first chamber (31) of the first positioning device (3) is disposed on the outer rim (111), and the first sliding seat (32) is inserted into the first chamber (31) so as to achieve effects of rapidly assembling and positioning the blind cord on the curtain reel structure.

In order to more rapidly position the winding spool (1) on the reel seat (2), the reel seat (2) is provided with a removable lock element (5) having a buckle (51) and a flexible member (6) pivotally connected to the removable lock element (5). The buckle (51) is further provide with a slot hole (511) for allowing insertion of the first sliding seat (32) for positioning before the first sliding seat (32) is inserted into the first chamber (31). More specifically, the winding spool (1) is disposed in the reel seat (2), and then the first sliding seat (32) is inserted into the first chamber (31) on the first axial part (11) by one end and into the slot hole (511) of the removable lock element (5) by the other end. Accordingly, the winding spool (1) can be positioned at a positive 90 degree and the first axial part (11) of the winding spool (1) can be locked. During the assembly of the relevant parts of the curtain reel structure (A), the winding spool (1) can be positioned once the slot hole (511) of the removable lock element (5) is engaged with the other end of the first sliding seat (32), which achieves effects of locking and positioning the winding spool (1) and rapidly completing the assembly of the curtain reel structure (A).

According to the above description, in comparison with the traditional technique, a curtain reel structure for assembling a blind cord rapidly according to the present invention has the advantages as following:

1. The present invention achieves effects of rapidly assembling and positioning the blind cord on a curtain reel structure by the first and the second positioning devices, which does not need to go through too many steps in the assembly process and can buckle the blind cord just by pulling the blind cord.

2. The first and the second positioning devices of the present invention can be applied to the reel seat or the winding spool, which achieves effects of simple operation, rapid assembly and stable positioning.

What is claimed is:

1. A curtain reel structure for assembling a blind cord rapidly, the curtain reel structure comprising:

a winding spool;

a reel seat on which the winding spool is assembled;

a first positioning device disposed between the winding spool and the reel seat and having a first chamber and a first sliding seat, wherein the first chamber is provided with a first opening for allowing insertion of the first sliding seat and a first active channel on the other side thereof for communicating the first chamber with an external, and wherein the first sliding seat is provided with a first accommodating slot for accommodating the blind cord and corresponding to or staggering with the first active channel;

a second positioning device disposed between the winding spool and the reel seat for assembling a curtain rail and having a second chamber and a second sliding seat, wherein the second chamber is provided with a second opening for allowing insertion of the second sliding seat and a second active channel on the other side thereof for communicating the second chamber with the external, and wherein the second sliding seat is provided with a second accommodating slot for accommodating the blind cord and corresponding to or staggering with the second active channel, a pull on the blind cord making the first accommodating slot of the first sliding seat and the second accommodating slot of the second sliding seat respectively stagger with the first active channel and the second active channel so as to lock the blind cord.

2. The curtain reel structure for assembling a blind cord rapidly as claimed in claim 1, wherein the winding spool is provided with a first axial part on which the first positioning device is assembled and having an outer rim at one end thereof and a second axial part at the other end thereof, and wherein the first chamber is located on the outer rim and provided with the first opening towards the external and the first active channel disposed on the outer rim.

3. The curtain reel structure for assembling a blind cord rapidly as claimed in claim 2, wherein the reel seat is provided with a first engaging part and a second engaging part above the second positioning device for pivotally connecting the winding spool, and a platform below the second engaging part, and wherein the second chamber is disposed within the platform and having the second opening towards the external and the second active channel disposed at a bottom of the platform.

4. The curtain reel structure for assembling a blind cord rapidly as claimed in claim 3, wherein inner walls of the first chamber and the second chamber are respectively provided with a first engaging unit and a second engaging unit, and wherein the first sliding seat and the second sliding seat are respectively provided with a first and a second joint units and a third and a fourth joint units.

5. The curtain reel structure for assembling a blind cord rapidly as claimed in claim 4, wherein the first engaging unit and the second engaging unit are formed as recessed slots or bumps, and the first and the second joint units and the third and the fourth joint units are formed as bumps or recessed slots respectively corresponding to the first engaging unit and the second engaging unit.

6. The curtain reel structure for assembling a blind cord rapidly as claimed in claim 3, wherein the first engaging part of the reel seat is provided with a removable lock element having a buckle and a flexible member pivotally connected to the removable lock element, and wherein the buckle is further provide with a slot hole for allowing insertion of the first sliding seat for positioning.

7. The curtain reel structure for assembling a blind cord rapidly as claimed in claim 2, wherein inner walls of the first chamber and the second chamber are respectively provided with a first engaging unit and a second engaging unit, and wherein the first sliding seat and the second sliding seat are respectively provided with a first and a second joint units and a third and a fourth joint units.

8. The curtain reel structure for assembling a blind cord rapidly as claimed in claim 7, wherein the first engaging unit and the second engaging unit are formed as recessed slots or bumps, and the first and the second joint units and the third and the fourth joint units are formed as bumps or recessed slots respectively corresponding to the first engaging unit and the second engaging unit.

* * * * *